United States Patent [19]

Meylan

[11] 4,095,702

[45] Jun. 20, 1978

[54] MAGAZINE FOR RECEIVING AND PILING DIE CUT BLANKS

[75] Inventor: Georges Meylan, Preverenges, Switzerland

[73] Assignee: J. Bobst & Fils, S.A., Switzerland

[21] Appl. No.: 621,007

[22] Filed: Oct. 9, 1975

[30] Foreign Application Priority Data

Nov. 6, 1974 Switzerland ..... 14821/74

[51] Int. Cl.[2] ..... B65G 57/03

[52] U.S. Cl. ..... 214/8; 214/6 DK; 271/189; 271/64; 271/218

[58] Field of Search ..... 214/6 DK, 6 D, 8; 221/289, 296; 271/189, 192, 218, 64; 74/25

[56] References Cited

U.S. PATENT DOCUMENTS

| | | | |
|---|---|---|---|
| 1,951,178 | 3/1934 | Smitmans | 214/6 DK |
| 2,893,573 | 7/1959 | Buccicone | 214/6 DK |
| 2,960,243 | 11/1960 | Beaulieu | 271/218 X |
| 3,270,630 | 9/1966 | Frappier | 214/6 DK X |
| 3,338,431 | 8/1967 | Thedick | 214/6 DK |
| 3,410,421 | 11/1968 | Groll | 214/6 DK |
| 3,446,368 | 5/1969 | Nelson | 214/6 DK |
| 3,480,503 | 11/1969 | Morrow | 214/6 DK X |
| 3,603,586 | 9/1971 | Hupfauf | 271/218 X |
| 3,799,540 | 3/1974 | Buccicone | 214/6 DK |

*Primary Examiner*—L. J. Paperner

*Attorney, Agent, or Firm*—Hill, Gross, Simpson, Van Santen, Steadman, Chiara & Simpson

[57] ABSTRACT

A device for receiving die cut blanks and forming a stack or pile of blanks within a magazine having at least a pair of spaced wall members which provide a pair of spaced parallel vertical wall surfaces of the chamber of the magazine characterized by at least one of the wall surfaces having a plurality of apertures and a device for retaining blanks in a pile in the magazine as a previously formed pile of blanks is being removed therefrom including a plurality of spaced fingers supported for movement in a direction perpendicular to the plane of the one wall surface between a first position extending through the spaced apertures into the chamber and a second position withdrawn from the chamber. To move the fingers between the positions the device for retaining includes an axle supported for rotation with its axis extending parallel to the vertical plane of the wall surface and the axle has means such as pins engaging each of the fingers to shift the fingers between the first and second positions as the axle is rotated. Preferably, the device for retaining includes a second axle in parallel spaced relation to the first axle which has pins for engaging a second set of fingers to shift them through a second wall surface of a chamber adjacent to the first mentioned chamber and the second axle is linked to be rotated by the first axle.

6 Claims, 4 Drawing Figures

MAGAZINE FOR RECEIVING AND PILING DIE CUT BLANKS

BACKGROUND OF THE INVENTION

1. Field of the Invention

The present invention is concerned with a device for receiving die cut board sheets and forming a stack or pile of blanks within at least one magazine which device includes means to retain a pile of blanks being formed as a previously formed pile is removed from the device.

2. Prior Art

Presently known blank stacking devices utilize a device for receiving the individual blanks and for retaining them in stacks or piles within a magazine. The magazines of the device are usually formed by wall members having spaced parallel wall surfaces which act as front and rear surfaces of the chamber of each of the adjacent magazines. These devices are usually provided with a plurality of fingers which are mounted for pivoting movement on a bottom surface of the wall members with the plurality of fingers being controlled collectively by a common pull rod to pivot them between an "off" position and an "on" position. While in the "off" position, the bars of each of the fingers do not protrude passed the wall surfaces into either of the chambers. When pivoted to an "on" position, the bars extend substantially perpendicular to the wall surfaces and into the chambers so as to form a partial grid or gate. The partial grid or gate will thus receive additional blanks being deposited in each of the chambers during the time when a previously formed pile is being removed from the bottom of the magazine. The operation and structure of the above described grid or gate is contained in my U.S. Pat. No. 3,870,213 issued on Mar. 11, 1975.

The reliability of magazines which receive and form piles of blanks which are provided with the above described grids or gates does not always live up to all expectations. For example, when handling die cut blanks formed of thin sheet material, the blank may become wedged between one or more of the fingers or bars and the bottom surface of the wall member. This will particularly happen when the fingers are being retracted to the "off" position and will cause a sheet having its edge wedged between the fingers and the bottom surface of the wall member to become jammed in the magazine. A jamming of the sheet not only impairs the piling or stacking operation, but will necessitate the shutting down of the entire stacking device until the jammed sheet is removed.

SUMMARY OF THE INVENTION

The present invention prevents the accidental retention or jamming of a sheet such as a die cut blank in a device for receiving die cut blanks and forming a stack or pile of blanks within a magazine having at least a pair of spaced wall members which provide a pair of spaced parallel vertical wall surfaces of a chamber of the magazine, and which device includes means for retaining blanks being formed into a pile in the magazine as a previously formed pile of blanks is being removed therefrom. To accomplish these tasks, the improvements comprise at least one of the pair of wall surfaces having a plurality of spaced apertures, said means for retaining including a plurality of spaced separate fingers supported for movement along a straight line in a direction perpendicular to the plane of said one wall surface between a first position extending through said spaced apertures into the chamber and a second position withdrawn from the chamber; and means for shifting the fingers along a straight line between said positions, said means for shifting including an axle support for rotation with its axis extending parallel to the vertical plane of said wall surface, said axle having means engaging each of said fingers and said means for shifting including an actuating device such as a pneumatic cylinder, a pull rod connected to the actuator device and extending to a lever attached to the axle. Preferably, the fingers are pins with a rectangular cross section. The means for engaging may comprise a plurality of spaced pins mounted on the axle with one pin associated with each of the separate fingers and each finger has a groove or a slot which receives an end of the pin. In an embodiment of the invention, the means for engaging comprises a plurality of spaced pinion gears disposed on the axle with one pinion gear meshed with a rack gear formed on a portion of the respective fingers.

When the retaining means is disposed in a wall member that separates two adjacent magazines, it has fingers aligned with apertures in a second wall spaced from the one wall surface and includes a second axle having pins arranged to shift a second set of fingers through the apertures in the second wall surface. The rotation of the second axle is controlled by an interconnecting means such as a pair of levers on the two axles that are interconnected by a pull rod or link so that all the pins are moved to a first position extended into their respective chambers and are moved to the second position retracted from their respective chambers simultaneously.

DESCRIPTION OF THE PREFERRED EMBODIMENT

Figure 1:
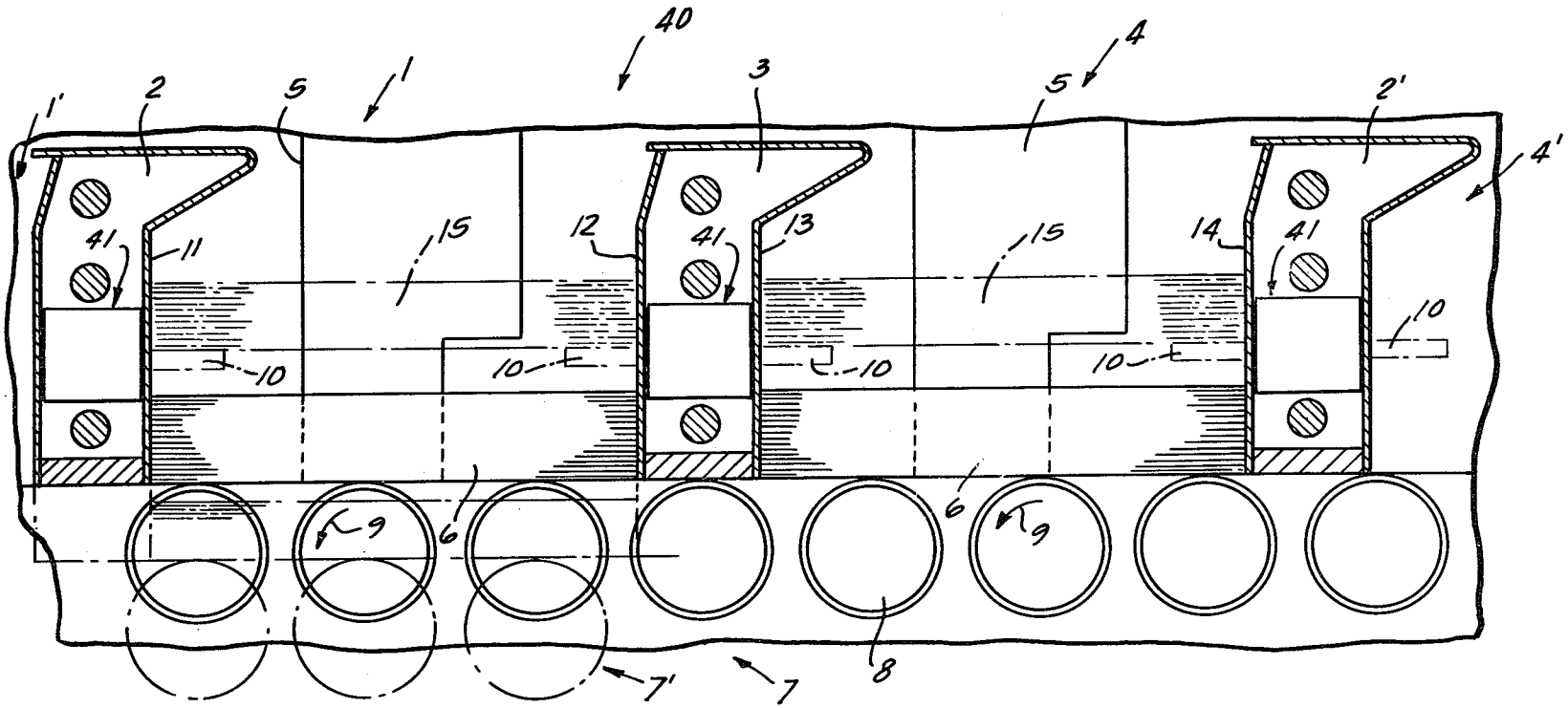
FIG. 1 is a partial cross section of the device for receiving sheets and forming piles in chambers in accordance with the present invention.

The principles of the present invention are particularly useful in a device generally indicated at 40 in FIG. 1 for receiving blanks and for piling blanks in spaced magazine such as the two mgazines generally indicated at 1 and 4. The magazine 1 has a chamber defined by spaced wall members 2 and 3 with the wall member 2 having a substantially vertically extending metal sheet 11 and the wall member 3 having a substantially vertically extending metal sheet 12 which will form front and rear walls of the chamber and coact with side walls or plate members 5 to complete the chamber. The side wall member 3 has a second metal sheet 13 which is spaced from the metal sheet 12 and forms a front wall surface of the chamber of the magazine 4 whose rear wall surface is formed by a metal sheet 14 of a wall member 2'. The chamber of magazine 4 is completed by side walls or plate member 5. Additional magazines such as 1' and 4' may be provided by providing wall members similar to 2, 2' or 3 which are spaced from the wall members 2 or 2'. Thus, the device 40 may have any number of magazines.

The bottom of each of the magazines 1 and 4 is formed by a descent device 7 which has a plurality of parallel rollers 8 whose surfaces coact to support the blanks as they are inserted into the magazines 1 and 4 to form stacks or piles 6 of blanks. To remove the piles of blanks from the magazines 1 and 4, the descent device 7 is lowered such as to a position generally indicated at 7' and the rollers 8 are rotated in the direction of arrow 9 to transport each of the stacks or piles 6 from beneath the device 40.

During the removal operation of the piles or stacks 6, additional blanks are continuing to be delivered to the device 40 and to be deposited in each of the magazines such as 1 and 4. In order to continue receiving and stacking additional blanks while the stacks or piles 6 are being removed, the device 40 has a plurality of retaining means generally indicated at 41 which retaining means are provided in the wall members 2, 2' and 3. Each of the retaining means 41 has a plurality of fingers 10 which are movable along a straight line path to extend passed the wall surfaces such as 11, 12 and 13 and 14 of the wall members 2, 2' and 3 at a point above the stacks 6 to cause subsequently deposited blanks to be formed in temporary stacks 15 which are spaced above the stacks or piles 6.

In normal operation of the device, the fingers 10 are in a retracted position and do not extend passed the wall surfaces such as 11, 12, 13 and 14 into the chamber of the magazines, so that all the blanks will be formed into the piles or stack 6. When the stack 6 reaches a predetermined height, the fingers 10 are moved into a gating or extended position to prevent the addition of additional blanks onto the stack 6 and to form the blanks in the temporary stacks 15. The descent device 7 is then lowered to remove the stacks 6. As it reaches a position such as indicated at 7', the rollers 8 are placed into rotation in the direction of arrow 9 to cause the stacks to be moved or transported from the device 40. After the stacks 6 have been removed, the descent device 7 is then returned to the position illustrated in bold lines and the fingers 10 are withdrawn or retracted to allow the temporary stacks 15 to fall onto the rollers and into the position of the previously formed stacks 6. After additional blanks have been deposited so that the newly formed stacks 6 again reach the predetermined height, the operation is repeated. Thus, the fingers 10 of the retaining means 41 for each of the chambers 1 and 4 enable the continual handling of blanks and the formation of a new stack as the previously formed stack is being removed from each of the chambers.

Figure 2:
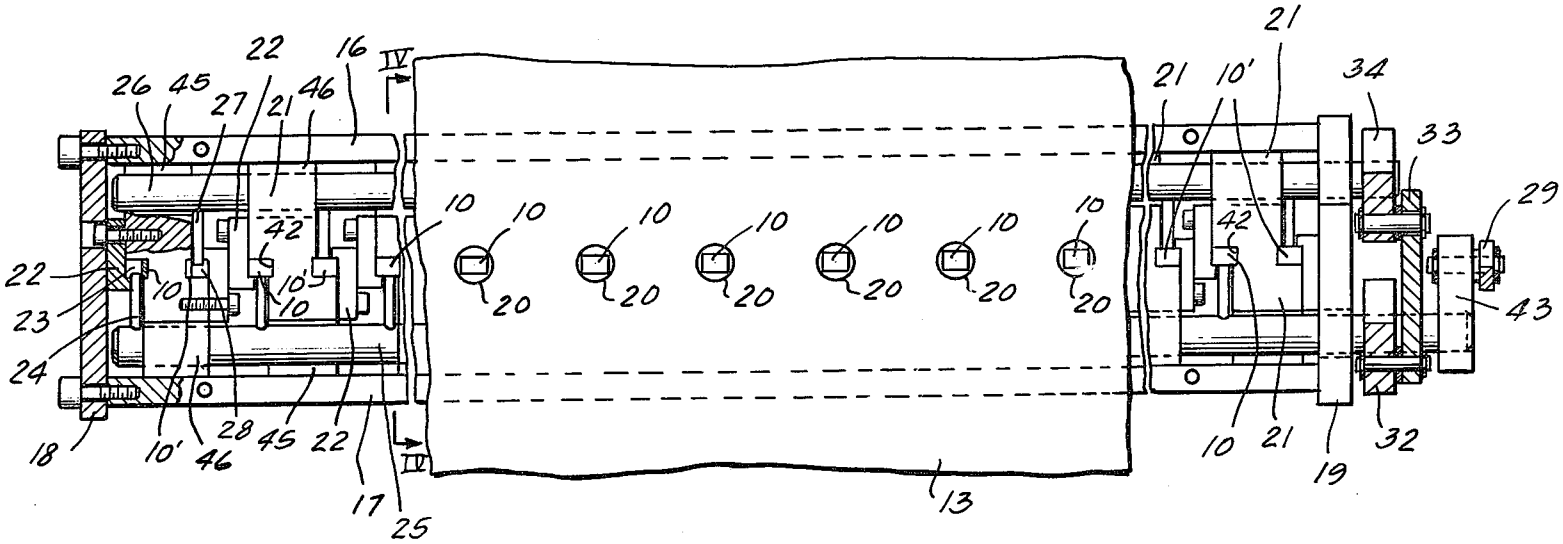
FIG. 2 is a side view of a wall of the chamber with portions removed and portions broken away for purposes of illustration of the retaining means of the present invention.
Figure 3:
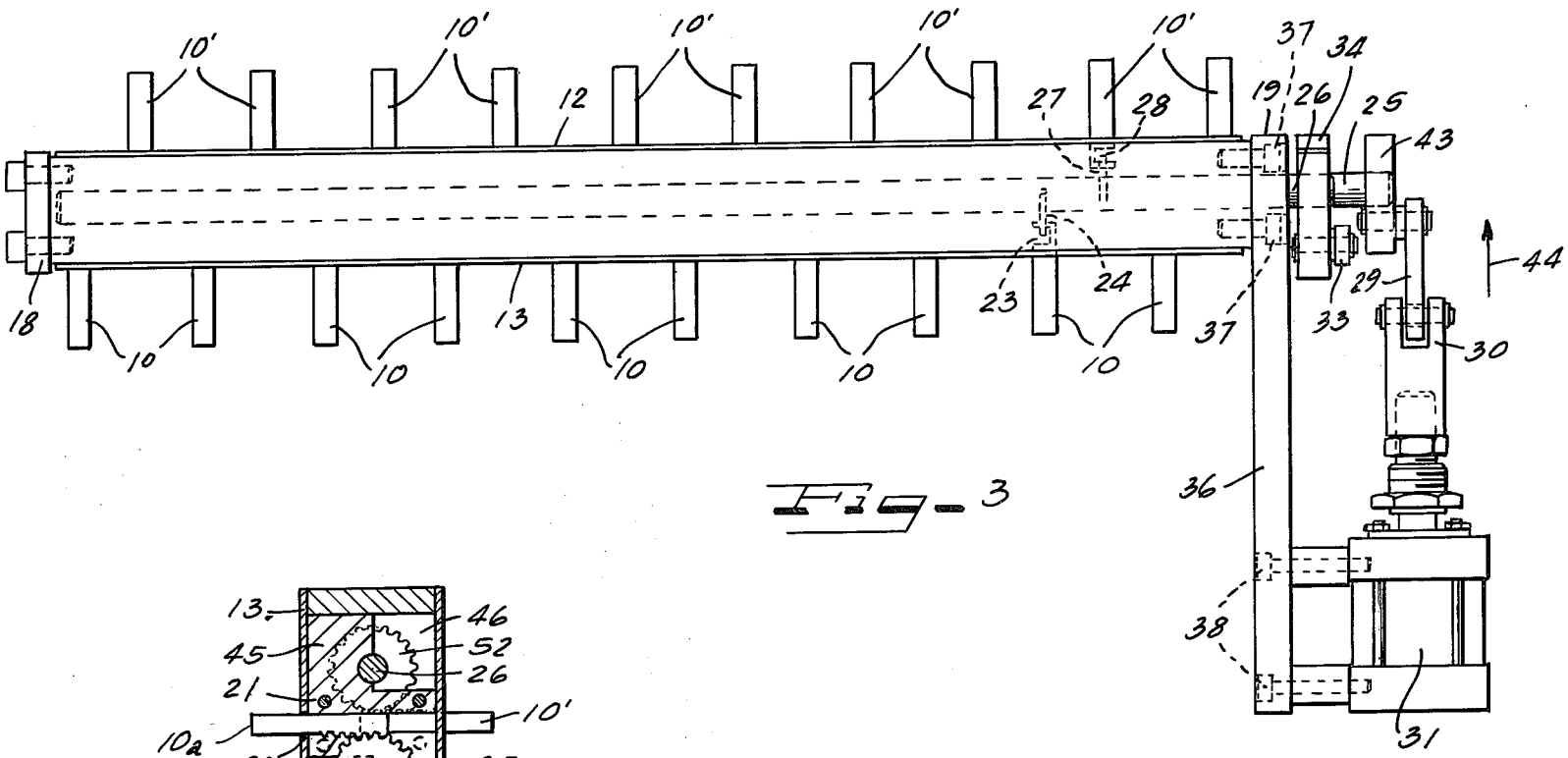
FIG. 3 is a top view of the wall member illustrated in FIG. 2.

As best illustrated in FIGS. 2 and 3, the fingers 10 of the retaining means 41 are arranged in two groups or sets 10 and 10' with the fingers of group 10' extending from one of the wall surfaces such as 12 and the fingers of group 10 extending from the other wall surface 13. The set of fingers 10 while on the same plane as the set of fingers 10' are offset so that as viewed in FIG. 3, adjacent fingers extend in opposite directions when in the extended position.

The retaining means 41 consists of a frame or housing which is made of two longitudinally extending crossbar or plate members 16 and 17 (FIG. 2) which are interconnected to one another at the ends by vertical end plates 18 and 19. As illustrated, the metal sheet 13 which forms the wall surface 13 consists of a bent steel plate which has a plurality of spaced, round apertures 20 through which the fingers of group 10 will extend into the chamber forming the magazine 4 as the fingers are moved to the extended position. In a similar manner, the metal sheet forming the surface 12 has similar apertures. Each of the fingers forming the sets 10 and 10' are guided for movement along a straight line path by guiding or sliding rails which are formed by an under cut 42 in a surface of a bearing member 21 and a keeper plate 22 which is attached to the bearing member 21.

To shift the fingers between the extended and retracted positions, each finger of group 10 has a groove or slots 23 (FIGS. 2 and 3) which receive an end of a pin 24 which is connected or mounted on an axle 25 that extends along the length of the housing formed by the crossbars 16 and 17 and plates 18 and 19. In a similar manner, a second axle 26 is disposed above the axle 25 and has a plurality of pins 27 whose free ends are engaged in grooves or slots 28 in the fingers of the set designated 10'.

To rotate the axle 25, a lever 43 is mounted on the axle and is connected by a pull rod 29 to a fork 30 of an actuator device which is illustrated as a pneumatic cylinder 31 (FIG. 3). To transmit the rotation of the axle 25 to the axle 26, means for transferring rotation interconnect each of the axles. As illustrated in FIG. 2, this means includes a lever 32 connected on the axle 25 which has a pull rod or link 33 extending to a similar lever 34 which is connected to the axle 26. Thus, when the cylinder 31 is actuated to shift the fork 30 in the direction of arrow 44 (FIG. 3), both of the axles or shafts 25 and 26 will be rotated in a clockwise direction to shift the sets 10 and 10' of the fingers along a straight line path from the illustrated extended position to a retracted position withdrawn into the housing of the retaining means 41 and with the fingers being withdrawn from the adjacent chambers of the adjacent magazines such as 1 and 4.

Both the axles 25 and 26 are rotatably supported in the end member or plate 19 and are guided within the housing by the plurality of bearing members 21. Each of the bearings 21 has the same shape with a pair of spaced portions 45 and 46 which support bearing halves so that adjacent bearing members 21 are rotated 180°. Thus, axle or shaft 25 is engaged on one side by the bearing portion 45 of one bearing member 21 and the next adjacent bearing member 21 engages the shaft 25 on the opposite side with bearing portion 46. Due to the same configuration, the bearing members 21 are interchangeable.

To mount the actuator on the housing formed by the crossbars 16 and 17 and the end plates 18 and 19, the end plate 19, as illustrated in FIG. 3, has an extension 36 and is attached to the crossbars by fastening means such as screws 37. The actuator is mounted on the extension 36 by screws 38. If a single actuator is being used to actuate all of the retaining means 40 in a plurality of the wall members such as 2, 2' and 3, linkage between the levers such as 43 can be utilized and the end plates 19 of the housing of the retaining means 40 which do not need to support an actuator can be replaced by an end plate having the configuration of the end plate 18.

Figure 4:
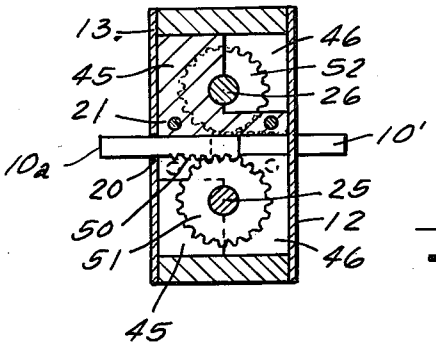
FIG. 4 is a cross section with portions in elevation taken along lines IV-IV of FIG. 2 and illustrates an embodiment of the invention.

Instead of using pins such as 24 engaged in the slots 23 as a means for transferring rotation from the axles to shift the fingers 10 in a straight line path in the sliding or guiding rails, the means for transferring or engaging may include providing a rack gear 50 (FIG. 4) on each finger 10*a* and a plurality of pinion gears 51 axially spaced on the axle 25 with one pinion gear 51 meshing with the rack gear 50 of each finger 10*a* of the set 10. In a similar axle 26 is provided with pinion gears 52 to mesh with rack gears which were cut in the fingers of set 10'.

With the fingers of the retaining means extending through apertures in the wall surfaces such as 12 and 13 of the wall member 3, retraction of the fingers cannot draw the edge of a blank into the aperture and therefore jamming or retaining a blank in the chamber will not occur. Another advantage of the system is its simplicity of construction which allows adjustment and that the sets 10 and 10' of fingers are shifted simultaneously between the extended position which is illustrated in FIG. 3 to a retracted position with the fingers being completely retracted from the chamber of the magazines 1 and 4.

Although various minor modifications may be suggested by those versed in the art, it should be understood that I wish to employ within the scope of the patent granted hereon, all such modifications as reasonably and properly come within the scope of my contribution to the art.

I claim:

1. In a device for receiving die cut blanks and forming a stack or pile of the blanks within a magazine having at least a pair of spaced wall members which provide a pair of spaced parallel vertical wall surfaces of a chamber of the magazine, said device including means for retaining blanks being formed into a pile in the magazine as a previously formed pile of blanks is being removed therefrom, the improvement comprising at least one of said pair of wall surfaces having a plurality of spaced apertures; and said means for retaining including a plurality of spaced separate fingers supported for movement only in a straight line path extending perpendicular to the plane of said one wall surface between a first position extending through said spaced apertures into the chamber and a second position withdrawn from said chamber; and means for shifting said fingers between said positions, said means for shifting including an axle supported for rotation with its axis extending parallel to the vertical plane of said wall surface, said axle having means for engaging each of said fingers and moving each finger in a straight line path as the axle is rotated, said means for engaging each of said fingers including a plurality of spaced pins mounted on the axle, and said means for shifting including an actuator device, a pull rod connected to the actuator device and extending to a lever attached to said axle.

2. In a device according to claim 1, wherein each of the spaced fingers has a groove and wherein the end of a pin for each finger is received in said groove.

3. In a device for receiving die cut blanks and forming a stack or pile of blanks within a first magazine having at least a pair of spaced wall members which provide a pair of spaced parallel vertical wall surfaces of a first chamber of the magazine, the device including at least a second magazine having a chamber separated by one of said pair of wall members from the chamber of the first magazine, said device including means for retaining blanks being formed into a pile in each of the magazines as a previously formed pile of blanks is being removed therefrom, the improvement comprising said one wall member having a first wall surface facing the first chamber and having a first plurality of spaced apertures and a second wall surface spaced from the first wall surface and having a second plurality of apertures, and said means for retaining being disposed between said first and said second wall surfaces, said means for retaining including a first plurality of spaced fingers supported for movement only in a direction perpendicular to the plane of said first wall surface between a first position extending through said spaced apertures into the first chamber and a second position withdrawn from said first chamber, a second plurality of fingers supported for movement perpendicular to the plane of the second wall surface between a first position extending through the apertures of the second wall surfaces into the second chamber and a position withdrawn from said second chamber, and means for shifting said first and second pluralities of fingers between said positions, said means for shifting the fingers including a first axle supported for rotation with its axis extending parallel to the vertical plane of said first wall surface, a second axle spaced from the first axle and supported for rotation with its axis parallel to said first axle, said first axle having means engaging each of the fingers of the first plurality of fingers, said second axle having means for engaging each of the fingers of the second plurality of fingers, and said means for shifting including an actuator device, a pull rod connected to the actuator device and extending to a lever attached to said first axle, and means for transferring rotation from the first axle to the second axle.

4. In a device according to claim 3, wherein all of the fingers have slots, and wherein the means for engaging the fingers comprise pins extending from each of said first and second axles and extending into the slot of the respective finger.

5. In a device according to claim 3, wherein the means for transferring rotation between the first and second axles comprises a lever disposed on each of said axles and a pull rod extending between said levers.

6. In a device for receiving die cut blanks and having at least two magazines each having a chamber in which a stack or pile of blanks is formed, the chambers of said two magazines being separated by a wall member having a pair of spaced wall surfaces forming a portion of adjacent chambers, said device including means for retaining blanks being formed into a pile in each magazine as a previously formed pile of blanks is being removed therefrom, the improvement comprising each wall surface of said pair of spaced wall surfaces having a plurality of spaced apertures, and said means for retaining being disposed in said wall member between said spaced wall surfaces and including a pair of sets of spaced fingers supported for movement only in a direction perpendicular to the plane of said wall surfaces between a first position extending through said spaced apertures into an adjacent chamber and a second position withdrawn from said adjacent chambers, and means for shifting each set of fingers between said positions including a first and second axle supported for rotation with their axes extending parallel to each other and parallel to the planes of each of said pair of wall surfaces, means for transferring movement of the first axle to one of the pair of sets of fingers and means for transferring movement of the second axle to the other of said pair of sets of fingers, means for rotating one of said first and second axles and means for transferring rotation from said one axle to the other axle of the first and second axles so that both sets of fingers are moved simultaneously to their first position and withdrawn simultaneously to their second position.

* * * * *